United States Patent [19]

Boliver

[11] 3,982,812

[45] Sept. 28, 1976

[54] POWER CABLE SEPARABLE CONNECTOR HAVING GASKET MEANS FOR RESTRICTING THE FLOW OF ARC-GENERATED GASES THEREFROM

[75] Inventor: Vincent J. Boliver, Pittsfield, Mass.

[73] Assignee: General Electric Company

[22] Filed: Oct. 1, 1973

[21] Appl. No.: 402,596

[52] U.S. Cl. ..... 339/111

[51] Int. Cl.[2] ..... H01R 15/02

[58] Field of Search ..... 339/111, 94; 200/144.1, 200/149.1, 144.3; 337/279, 280, 282

[56] References Cited

UNITED STATES PATENTS

| | | | |
|---|---|---|---|
| 3,542,986 | 11/1970 | Kotski | 200/149 A |
| 3,550,065 | 12/1970 | Phillips | 339/94 M |
| 3,663,928 | 5/1972 | Keto et al. | 339/111 |
| 3,772,636 | 11/1973 | Webb | 339/111 |

FOREIGN PATENTS OR APPLICATIONS

| | | | |
|---|---|---|---|
| 1,156,891 | 11/1963 | Germany | 339/111 |

*Primary Examiner*—Richard E. Moore
*Attorney, Agent, or Firm*—V. R. Ulbrich

[57] ABSTRACT

A high voltage electrical cable separable connector module comprises an internal gas flow-restricting gasket to restrict an undesirable flow of ionized arc-generated gases from the module upon live disconnection of the module from an electrical circuit. By restricting the flow of ionized gas in the module, its arc interrupting capability is enhanced, and at the same time, the risk of an arc restrike upon disconnection is appreciably reduced.

10 Claims, 3 Drawing Figures

POWER CABLE SEPARABLE CONNECTOR HAVING GASKET MEANS FOR RESTRICTING THE FLOW OF ARC-GENERATED GASES THEREFROM

BACKGROUND OF THE INVENTION

The present invention relates generally to separable connector modules for electrical power cables and particularly to a type of module commonly used in high voltage underground electric power distribution systems to connect the cables and operating components of such a system. Electrical power cables used in underground power distribution are commonly provided with waterproof connector modules at their ends. These modules may connect cable-to-cable or cable-to-component, such as to a transformer bushing terminal. In general, such modules consist of a matching pair of male and female contacts each disposed inside a separate and matching insulating housing. The insulating housings are mated together in matching relationship to provide a waterproof and stress-relieving connection. Such modules are commonly disconnected from a live circuit, despite certain arcing hazards known to be involved in such a loadbreak procedure. They are therefor generally designed to minimize certain of these hazards.

The male contact is a conducting rod having an end portion known as an arc-follower made of a material which, in response to arcing across its surface, gives off arc extinguishing gases.

The female contact generally includes a resilient conductive grasping member for making firm electrical contact to the rod of the male contact.

The rod is guided to the female contact by a bore provided in the insulating portion of the housing. Behind the female contact assembly, there may be a gas pressure chamber for holding excess gas generated during disconnection. The bore of the female contact module may be provided with a replaceable bore sleeve having an inside liner of arc extinguishing material.

When the rod is pulled from the female contact and out through the bore in the disconnecting process, an arc is drawn between the rod and the female contact. This arc plays over the arc extinguishing material of the bore sleeve liner and the arc-follower to generate arc-extinguishing gases. These gases appear suddenly and can, at relatively high voltages of, for instance, 13 kilovolts, result in sudden high gas pressure inside the bore. The generated gas plays an essential role in extinguishing the arc before the rod is pulled from the bore.

A common failure mode of the type of connector module described above is that during the disconnection process, some of the hot ionized gases generated by the arcing inside the module escape from the module as the rod is being removed from the bore to result in the establishing of an arc outside the module. Once such an arch through outside air is established it cannot be extinguished and tends to jump to a nearby grounded object to produce a short circuit.

Various means have been devised for minimizing the escape of hot arc-generated from the module upon disconnection. Examples of such means are described, for instance, in the following:

U.S. Pat. Nos. 3,587,035 issued June 22, 1971 to E. J. Kotski; 3,539,972 issued Nov. 10, 1970 to Reute et al.; 3,542,986 issued Nov. 24, 1970 to E. J. Kotski;

U.S. Pat. application Ser. No. 160,798 filed July 8, 1971 entitled "Electric Cable Termination Module Having a Gas Trap Valve" and assigned to General Electric Company.

U.S. Pat. application Ser. No. 181,416 filed September 17, 1971, entitled "Electric Circuit Interrupter Having Means Restricting Flow of Arc Generated Gases Therefrom" now abandoned in favor of a continuation application Ser. No. 387,759 filed Aug. 13, 1973, also now abandoned in favor of a continuation application Ser. No. 514,949 filed Oct. 15, 1974, all assigned to General Electric Company.

The approaches to preventing the escape of hot arc-generated gases from the module on disconnection include installing gas retaining gaskets near the inside end of the bore to prevent the gases from rushing out between the rod and the bore sleeve liner.

In addition to the gaskets near the end of the bore, there may be provided a gas trap valve which prevents gases from leaving the bore after the arc-follower has left the bore. Also, a gas retaining chamber can be provided in order to prevent excessive pressure build-up which would increase the amount of escaping gas.

After a number of disconnections, female contacts of the module of the type described above generally become damaged by the arcing that takes place at each disconnection. It is therefore common practice to manufacture the female contact integrally with a cylindrical bore sleeve as a replaceable sleeve and contact unit. The sleeve and contact unit may be screwed into the housing.

It has been found, however, that modules having such a replaceable bore sleeve unit are subject to a failure mode of the gas restrike type even, when provided with all three of the above-described prior features for preventing the escape of hot arc-generated gas from the module.

SUMMARY OF THE INVENTION

In the novel connector module, a replaceable bore sleeve and contact unit is provided with a resilient gasket about its outside wall to seal the space between the outside wall of the unit and the inside wall of the opening in a housing into which the unit is fitted.

The resilient gasket between the sleeve and contact and the inside wall of the module housing impedes the escape of gases from the gas chamber of the module into the region between the bore sleeve and the interior wall of the housing sufficiently to prevent a restriking of an arc after removal of the rod from the bore.

DESCRIPTION OF THE PREFERRED EMBODIMENTS

Figure 1:
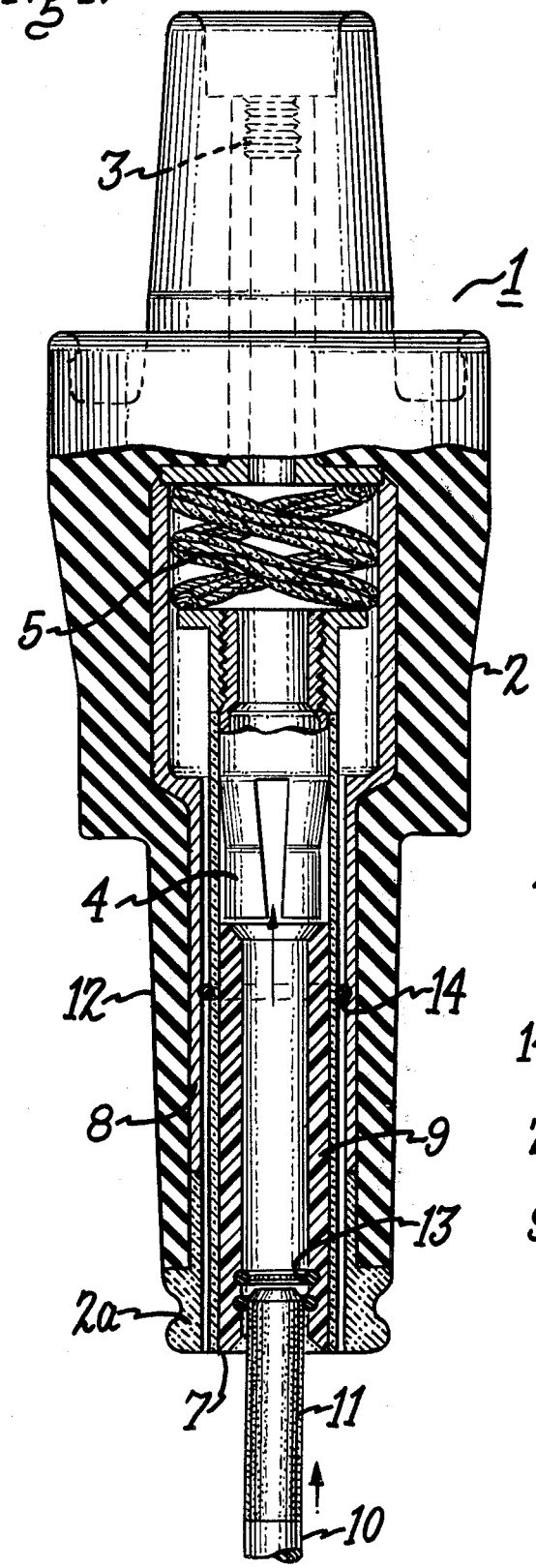
FIG. 1 is a cut-away view of a connector module in accordance with a preferred embodiment of the invention. Included in the FIG. 1 is the end portion of a rod shown entering the bore of the module.

Referring now to FIG. 1 of the drawing, there is shown a loadbreak cable connector module 1 in the form of an insert bushing that is adapted to cooperate with a second bushing module to be supported in operating position by it. It will become apparent from the following description that the invention may be housed in various types of conductor connector modules; therefore, the general configuration of such a module, e.g., module 1, is not an important factor in understanding or applying the invention. An example of a suitable cooperating bushing module, with which the module 1 may be supported, is illustrated and described in U.S. Pat. No. 3,551,587 — Propst, which issued Dec. 29, 1970 and is assigned to the assignee of the present invention. It is only necessary to an understanding of the invention described herein to recognize that the module 1 includes an elongated insulating housing 2 and having end flange 2*a*. A threaded terminal conductor 3 is mounted at one end of the housing 2 and is in electrically conducting relationship with a reciprocally movable female contact 4, through a flexible coiled conductor 5 that forms a circuit between the terminal conductor 3 and the movable contact 4.

The movable contact 4 is mounted in fixed relationship with respect to a hollow, cylindrically shaped insulating sleeve and contact unit 7 that is adapted to move in relationship to metal cylinder 8 which forms the inside wall of the housing to provide a load-break operation in a manner that is generally known in the prior art. The end of the cylinder 8 is insulatingly spaced from the end portion of the bore by the insulating flange 2. If a more detailed description of such a reciprocally operable loadbreak type cable connector module is desired, a description of such a mechanism is given in U.S. Pat. No. 3,542,986 — Kotski, which issued Nov. 24, 1970 and is assigned to the assignee of the present invention.

Mounted on the interior surface of the sleeve and contact unit 7 is a bore sleeve liner 9 of a material such as a suitably stable polyoxymethylene, nylon, or a cycloaliphatic resin for evolving arc-extinguishing gas when subjected to arcing. One example of such a suitable resin is disclosed in U.S. Pat. No. 3,586,802 — Nichols et al., which issued June 22, 1971 and is assigned to General Electric Company.

As shown in FIG. 1, a movable contact rod 10, having an arc follower 11 formed of gas-evolving material, which may be similar to that of the materials of the liner 9, is shown positioned for insertion into engagement with the movable female contact 4 to complete an electrical circuit between the female contact 4 and rod 10. Such a circuit is shown, for example, in the assembled position of the electric cable separable connector modules illustrated in the above-mentioned Propst patent. As is well known, the contact rod 10 is normally supported in a second module, not shown, that includes an elongated insulating housing having a voltage-grading sealing surface that is adapted to cooperate with the frustoconical surface 12 of module 1 to form a watertight seal therewith when the contacts 4 and 10 are moved together to complete a circuit.

Gas-restricting "O" ring gaskets 13 are provided inside the liner 9 adjacent the outermost end of the bore to restrict the flow of gases between the rod 10 and liner 9.

Figure 2:
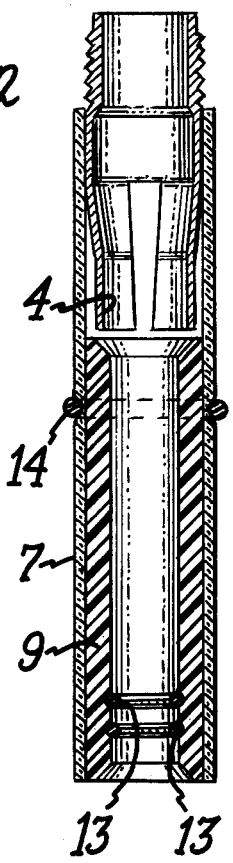
FIG. 2 is a side-sectional view of a sleeve and contact unit of the module of FIG. 1 in accordance with a preferred embodiment of the invention.

The bore sleeve and contact unit 7 member is provided about its outer surface with a gasket 14 to seal the space between it and the metal cylinder 8 which is the inside wall of the housing. The gasket 14 is an "O" ring lying in a groove which is machined into the outer part of the sleeve and contact unit 7. The unit 7 with gasket 14 is shown separately in FIG. 2 with like reference numerals.

The gasket 14 provided around the bore sleeve and contact unit 7 prevents such gases from escaping through that region rapidly enough to result in arcing, thus preventing the failure mode described above for this type of connector.

Figure 3:
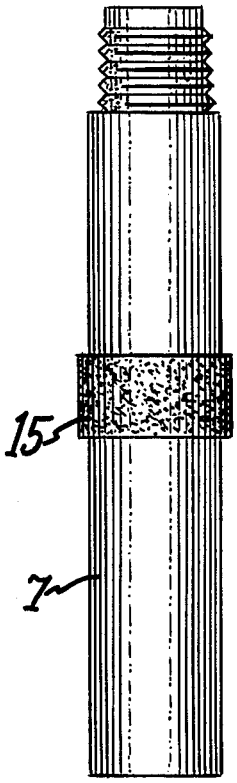
FIG. 3 is a side view of a sleeve and contact unit of the module of FIG. 1 in accordance with another embodiment of the invention.

In another embodiment of the invention, shown in FIG. 3, a gasket provided around the bore sleeve is a strip 15 of resilient polyurethane foam about ⅛ inch thick and ¾ inch wide, coated on one side with an adhesive. The strip 15 is wrapped around the sleeve and contact unit 7 with a short overlap of about ½ inch. This embodiment of the invention is in some respects more desirable than the first embodiment in that such an adhesive strip is less costly to apply to the bore sleeve, since it involves no matching and is a relatively fast operation.

GENERAL CONSIDERATIONS

While a connector module of the type having a replaceable bore sleeve and contact unit functions properly at voltage levels on the order of 8 kilovolts when provided with a gas-trap valve, a gas retaining chamber, and gaskets inside the end portion of the sleeve liner, such a module nevertheless is subject to a restrike failure mode at higher voltage ratings on the order of 13 kilovolts. This failure mode has been found to result from the escape of arc-generated gases from the gas chamber, around the piston, and through the space between the sleeve and contact unit and the aluminum cylinder wall of the housing to the outside air at the end of the housing. Such escaping gas, being sufficiently ionized, causes a restriking in which an arc appears from the conductive part of the rod to the metal cylinder housing wall by passing between the inside of the housing wall and the outside of the sleeve and contact assembly. This arc may then jump to a nearby grounded member to cause a line-to-ground fault. Another effect is that the gas escaping from this space results in the depositing of cnductive contaminants on the surfaces in that space. The deposits of conductive contaminants impair the insulating function of the insulating flange at the end of the housing, so that an arc can be struck directly to the end of the flange from the rod as it is withdrawn.

While the escape of gas through the space as described above can be restricted by simply providing less clearance between the sleeve and contact unit and the inside wall of the housing, this solution is not highly feasible for existing manufacturing techniques for such modules. The sleeve and contact unit is a relatively costly portion of the entire module. For this reason, the unit is made to be interchangeable for several different types of housings. For instance, the same unit is provided for a cast epoxy housing as is provided for an injected polymer housing. Because inside wall tolerances for different types of housings made by different techniques need to have a wide latitude when such different production techniques such as injection molding and epoxy casting are used, it follows that an interchangeable sleeve and contact unit must have a rather loose fit in order to be suitable for such interchangeability. Also, providing a clearance sufficiently small to prevent the failure modes in question here would involve considerable increased cost of manufacturing.

With the novel invention, the interchangeability of the bore sleeve unit is retained while very little added cost is needed to provide the resilient gasket about its periphery. No changes need be made in existing assembly procedures for the module, except to add the gasket prior to insertion of the sleeve, and contact unit into the module housing.

In the preferred embodiment, there are described an "O" ring gasket and a foam strip seal about the sleeve and contact member. It should be understood, of course, that the type of gasket and the particular dimension of materials used are relatively non-critical so long as the seal is sufficient to prevent arc-generated gases from escaping from the end of the housing to result in an arc.

The gasket may, of course, also be installed about the inside wall of the bore to cooperate with the sleeve after insertion to form the required seal.

The bore sleeve may or may not have a contact assembly integral with it. The invention is applicable to any such module wherein arc-generated gas can escape between a housing wall and a bore sleeve to result in a restrike problem, independent of other structures, such as "O" rings inside the end of the sleeve liner, which may be additionally provided for preventing gas escape from the module. Moreover, the bore sleeve may, of course, be provided with features in addition to those described herein, such as a gas-trap valve, minimizing problems which result from gases escaping directly from the bore.

I claim:

1. A separable connector module for connecting electrical power distribution cable, the module being of the type including:

an insulating housing having an open contact-receiving passageway therein extending from a first end of said housing a predetermined distance into said housing and terminating in a gas expansion chamber;

a hollow, cylindrical, bore sleeve telescopingly fit inside said passageway of said housing;

an electrical contact member inside said passageway and rigidly fixed to said bore sleeve, and a gas activated piston for moving said bore sleeve along said passageway, said piston being disposed in said chamber and having an opening through which gases generated in said passageway by arcing from said contact member can pass from said passageway into said chamber, wherein the improvement comprises a resilient gasket in the space between the bore sleeve and the inside wall of said passageway for preventing escape of arc-generated gases to the outside through that space.

2. The module defined in claim 1, wherein the gasket is a resilient "O" ring disposed in a groove provided about the outside of the bore sleeve.

3. The module defined in claim 1, wherein the gasket is a strip of resilient foam wrapped about the outside of the bore sleeve.

4. The module defined in claim 3, wherein the foam strip is of a polyurethane foam.

5. The module defined in claim 4, wherein the strip is provided on one surface with an adhesive film for adhering to the bore sleeve.

6. The module defined in claim 1, wherein the bore sleeve has attached at one end a conductive female contact assembly and wherein the bore sleeve and contact assembly are removably attached as a unit to the module housing.

7. The module as defined in claim 6, and wherein the bore sleeve comprises an inner liner of a material which evolves arc-quenching gases when subjected to an electric arc.

8. The module defined in claim 7, wherein the gasket is a strip of foam wrapped around the outside of the bore sleeve.

9. The module defined in claim 8, and wherein the female contact assembly and bore sleeve unit is threaded into the housing.

10. The module as defined in claim 9, and comprising a movable piston inside the housing, the piston being disposed in the housing in such a manner that gases under pressure can escape past the piston into the space between the housing passageway wall and the outside of the bore sleeve.

* * * * *